US008978699B2

(12) United States Patent
Jaffrey et al.

(10) Patent No.: US 8,978,699 B2
(45) Date of Patent: Mar. 17, 2015

(54) BLOWOUT PREVENTER STATUS ASSEMBLY

(75) Inventors: Andrew Jaffrey, Oldmeldrum (GB); Gerrit M. Kroesen, Friendswood, TX (US); John Mangan, Houston, TX (US)

(73) Assignee: Cameron International Corporation, Houston, TX (US)

( * ) Notice: Subject to any disclaimer, the term of this patent is extended or adjusted under 35 U.S.C. 154(b) by 288 days.

(21) Appl. No.: 13/606,363

(22) Filed: Sep. 7, 2012

(65) Prior Publication Data

US 2014/0069531 A1 Mar. 13, 2014

(51) Int. Cl.
*F16K 37/00* (2006.01)
*E21B 33/06* (2006.01)
*E21B 33/076* (2006.01)

(52) U.S. Cl.
CPC ..... *E21B 33/061* (2013.01); *E21B 33/076* (2013.01)
USPC ..... 137/552; 137/553; 137/554; 251/1.3

(58) Field of Classification Search
CPC ..... E21B 33/06; E21B 33/061; E21B 33/062; F16K 37/0008; F16K 37/0016; F16K 37/0025
USPC ..... 137/552, 553, 554, 556, 556.3, 556.6; 251/1.3
See application file for complete search history.

(56) References Cited

U.S. PATENT DOCUMENTS 1,229,860 A * 6/1917 Ashelman et al. ..... 137/556.3
1,854,058 A * 4/1932 Otis ..... 251/1.3
1,994,336 A * 3/1935 Dawson ..... 137/553
2,422,119 A * 6/1947 Muller ..... 137/553
4,214,605 A * 7/1980 Hardgrave ..... 137/556
4,384,612 A 5/1983 Bradford et al.
5,178,185 A * 1/1993 Stehling et al. ..... 137/556.3
7,300,033 B1 11/2007 Whitby et al.
7,331,562 B2 * 2/2008 Springett ..... 251/1.3
2008/0040070 A1 2/2008 McClanahan
2008/0135291 A1 6/2008 Hall et al.
2010/0152901 A1 6/2010 Judge et al.
2012/0000646 A1 * 1/2012 Liotta et al. ..... 251/1.3
2012/0001101 A1 1/2012 Dietz et al.
2012/0234410 A1 * 9/2012 Borchgrevink et al. ..... 137/556

OTHER PUBLICATIONS

International Search Report and Written Opinion dated Dec. 16, 2013 for PCT Application No. PCT/US2013/058165 filed Sep. 5, 2013.

* cited by examiner

*Primary Examiner* — John Rivell
(74) *Attorney, Agent, or Firm* — Chamberlain Hrdlicka

(57) ABSTRACT

A status assembly to provide visual and electronic indication of the position (open, closed, in-between) of the ram of a ram-type blowout preventer (BOP). The assembly is capable of coupling with a hydraulic motor that can be used to open and close the ram locks. The status assembly includes a rotatable element protruding from the BOP, a gear rotatable by the rotatable element, and an indicator that indicates the rotation position of the rotatable element and thus the linear position of the BOP ram. Some embodiments can also include a sensor that outputs an electronic signal to the system operator and can be incorporated into the main display for the BOP control system. This device is able to give immediate feedback to operators and to indicate whether each ram has achieved its intended travel.

23 Claims, 7 Drawing Sheets

BLOWOUT PREVENTER STATUS ASSEMBLY

BACKGROUND

Normally, when drilling oil and gas wells, a blow-out preventor (BOP) is installed for controlling pressure in the well when needed. A BOP can be designed for both land and subsea operations. BOPs are used to seal and control the fluid pressure of the well and they are designed to cope with extreme erratic pressures and uncontrolled flow emanating from a well reservoir during drilling.

A ram-type BOP is similar in operation to a gate valve, but uses a pair of opposing steel plungers (rams). The rams extend toward the center of the wellbore to a closed position to restrict flow or retract open in order to permit flow. The inner and top faces of the rams are fitted with packers (elastomeric seals) that press against each other, against the wellbore, and around tubing running through the wellbore. Outlets at the sides of the BOP housing (body) are used for connection to choke and kill lines or valves. There are a number of different types of rams: pipe, blind, shear, and blind shear. Pipe rams close around a drill pipe, restricting flow in the annulus (ring-shaped space between concentric objects) between the outside of the drill pipe and the wellbore, but do not obstruct flow within the drill pipe. Blind rams (also known as sealing rams) have no openings for tubing, and can close off the well when the well does not contain a drill string (or other tubing), and seal it. Shear rams cut through the drill string or casing with hardened steel shears. Blind shear rams (also known as shear seal rams, or sealing shear rams) are intended to seal a wellbore, even when the bore is occupied by a drill string, by cutting through the drill string as the rams close off the well.

Ram-type BOPs are often configured to be operated using pressurized hydraulic fluid to control the position of the closure members relative to the bore. Although most BOPs are coupled to a fluid pump or some other active source of pressurized hydraulic fluid, many applications require a certain volume of pressurized hydraulic fluid to be stored and immediately available to operate the BOP in the case of emergency.

With an ROV intervention, it can be extremely difficult to know whether a ram BOP is fully open or fully closed due to the enclosed nature of the apparatus. An ROV pilot does not see, and thus, is not able to know whether or not the ram BOP is fully open or closed.

BRIEF DESCRIPTION OF THE DRAWINGS

A better understanding of the various disclosed system and method embodiments can be obtained when the following detailed description is considered in conjunction with the drawings, in which.

DETAILED DESCRIPTION

Figure 1:
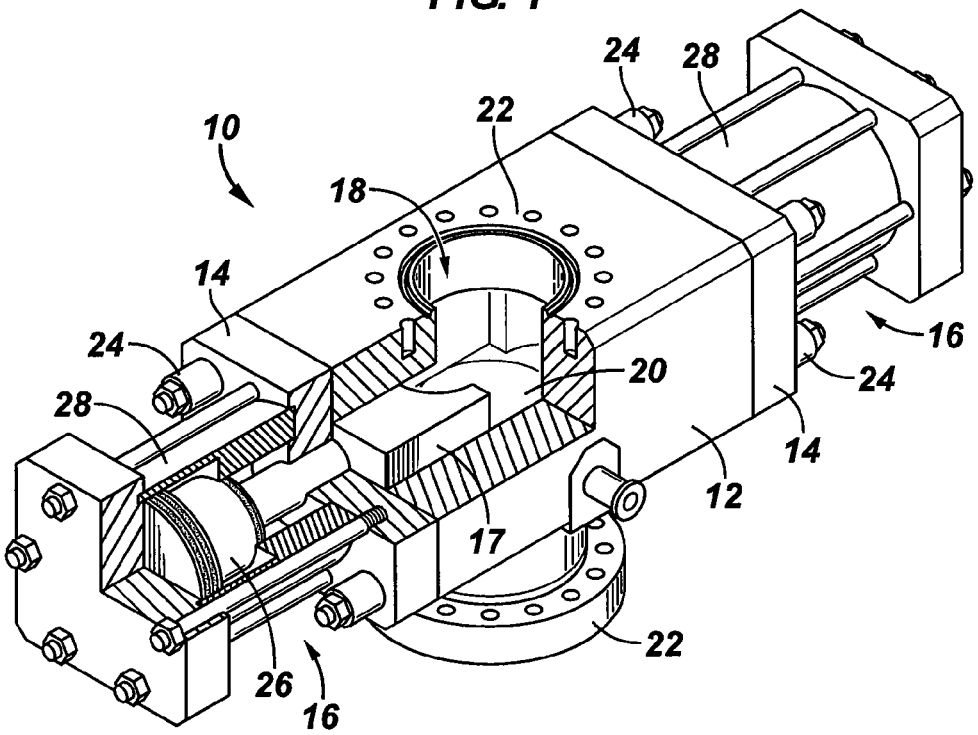
FIG. 1 is a blowout preventer constructed in accordance with embodiments of this invention.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

FIG. 1 shows a blowout preventer (BOP) 10 that is suitable for use with the status assembly. The BOP comprises body 12, bonnets 14, operator systems 16, and closure members 17. The body 12 comprises a bore 18, opposed cavities 20, and upper and lower bolted connections 22 for assembling additional components above and below the BOP 10, such as in a blowout preventer stack assembly. The bonnets 14 are coupled to the body 12 by connectors 24 that allow the bonnets to be removed from the body to provide access to the closure members 17. The operator systems 16 are mounted to the bonnets 14 and utilize hydraulic piston 26 and cylinder 28 arrangements to move the closure members 17 through the cavities 20, into and out of the bore 18.

Figure 2:
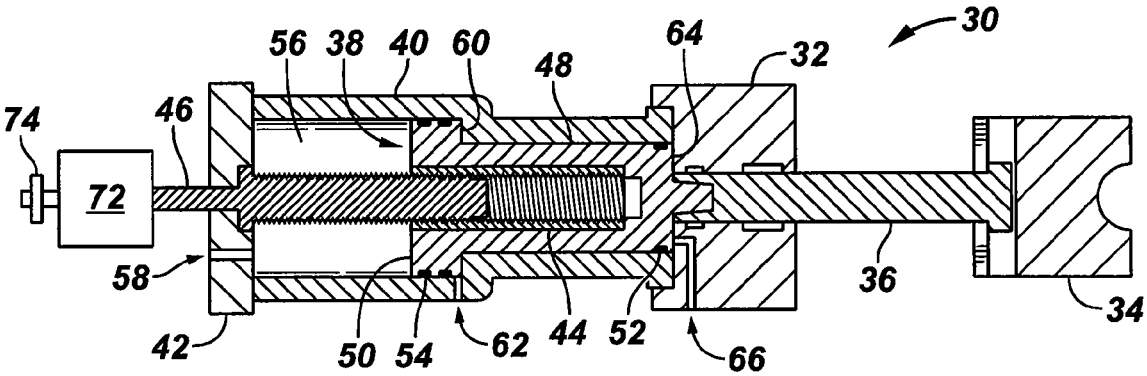
FIG. 2 is a cross-sectional view of a hydraulic operator in an extended and locked position in accordance with embodiments of the present invention.

FIG. 2 is an illustrative example of a hydraulic operator for a BOP in accordance with the embodiments of the present invention.

A BOP can include a body, bonnets, operator systems, and closure members. The body can include a bore, opposed cavities, and upper and lower bolted connections for assembling additional components above and below the BOP, such as in a BOP stack assembly. Bonnets 32 are connected with the body by connectors that allow the bonnets to be removed from the body to provide access to the closure members 34. The operator systems are mounted to the bonnets 32 and utilize a hydraulic piston and cylinder arrangement. The operator systems (one for each closure member 34) include a piston rod 36, a piston 38, an operator housing 40, a head 42, a sliding sleeve 44, and a lock rod 46. In the example shown, the piston 38 includes a body and a flange 50.

Once piston 38 moves toward bonnet 32 to the closed position, the piston may be locked in the closed position by rotating a lock rod 46. The threaded engagement of the lock rod 46 and a sliding sleeve 44 causes the sleeve 44 to move linearly relative to the lock rod 46. The lock rod 46 is rotated until the sleeve 44 contacts a shoulder of the piston 38, preventing the movement of the piston away from bonnet 32. The threaded engagement of the lock rod 46 and the sliding sleeve 44 is self-locking to the extent that linear force on the sliding sleeve 44 in the axial direction will not rotate the sleeve 44 relative to the lock rod 46. Thus, when sliding sleeve 44 is in contact with the shoulder, the piston 38 is prevented from moving away from the bonnet 32. Once the sliding sleeve 44 is engaged with the shoulder, the pressure within extend chamber 56 can be reduced and the piston 38 will remain in the extended position. In this manner, the sliding sleeve 44 and the lock rod 46 operate as a locking system that can be engaged to prevent closure member 34 from opening unintentionally. Although only shown in the fully extended and locked position, the sliding sleeve 44 can engage and lock against the piston 38 in any position.

In order to move the operator system 30 back to the retracted position, hydraulic pressure is first applied to the extend chamber 56. This removes any axial compressive load from the sliding sleeve 44 and the lock rod 46 and allows the lock rod 46 to be rotated. The rotation of the lock rod 46 moves the sliding sleeve 44 away from the shoulder Hydraulic pressure can then be applied to the retract chamber 64 so as to move the piston 38 back toward the retracted position.

The lock rod 46 can be rotated by a variety of electric motors, hydraulic motors, or other rotating devices. In certain embodiments, the motor is a hydraulic motor that can provide torque sufficient enough to effect the lock. The lock rod 46 can be coupled to a motor 72 via transmission system that transfers motion from the motor to the lock rod. Although the embodiment shown does not include a transmission system, other embodiments may include an intermediate apparatus linking the motor and the lock rod 46. In certain embodiments, the system and the motor 72 are equipped with backup systems that allow manual operation of the lock rod 46, such as by a remotely operated vehicle (ROV). The ROV could be used to supply hydraulic fluid or electrical power to operate motor 72 or could be used to directly rotate the lock rod 46. It should be appreciated that although FIG. 2 only shows half of a BOP and only one operator, an actual BOP may include more than one ram and operator, with the BOP including a status assembly 74 on each ram. Further, it should be noted that measurements can be taken from indicators on each ram, and thus the travel distances can differ as oppose to meeting exactly in the middle of the bore 18 shown in FIG. 1. Also, it should be noted that the entire status indicator system can include more than one BOP.

Figure 3:
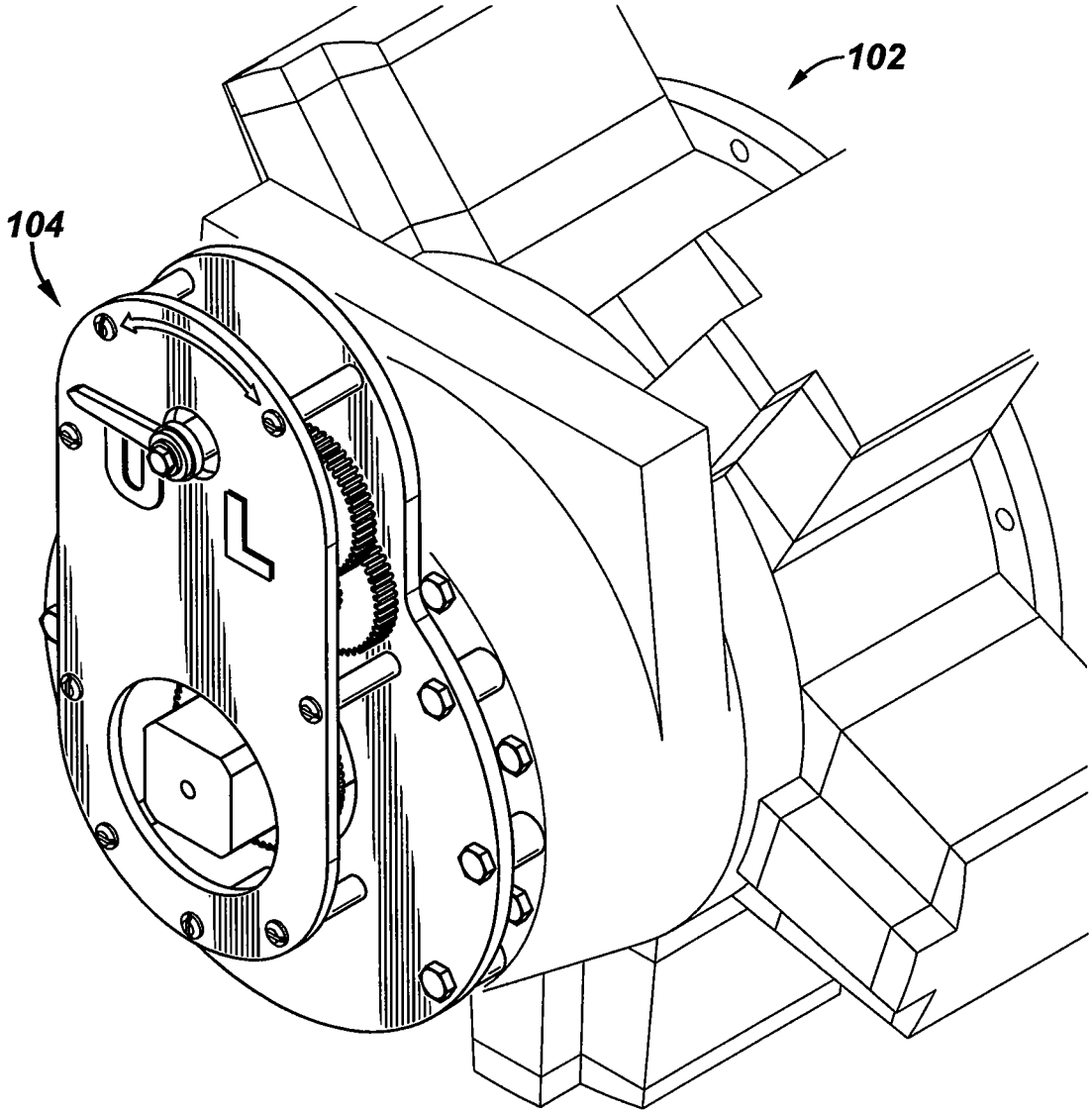
FIG. 3 is an illustrative configuration of the lock status indicator attached to a hydraulic motor.
Figure 5:
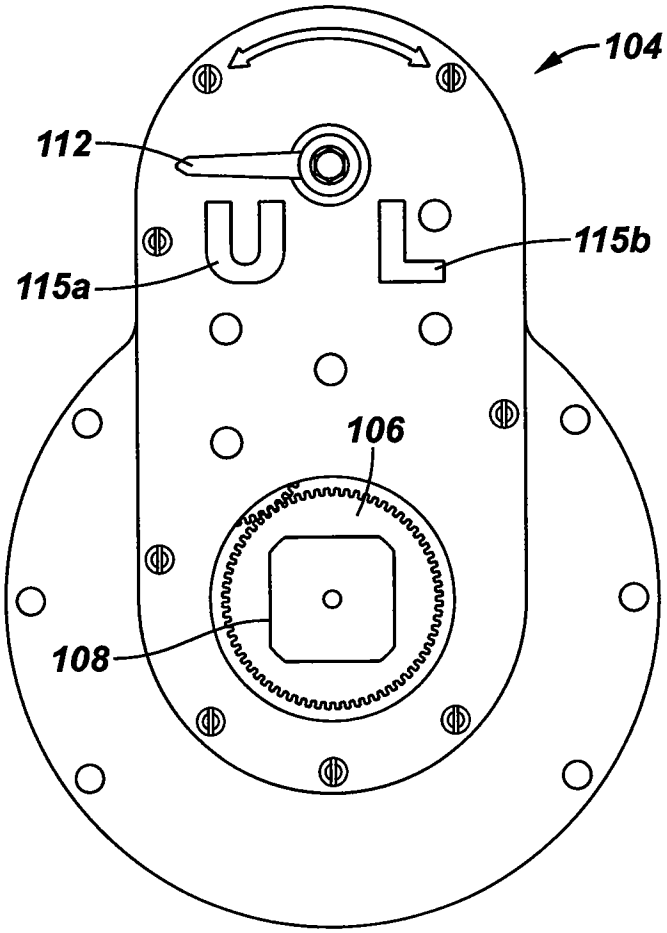
FIG. 5 is an illustrative front view of the gear assembly.
Figure 4:
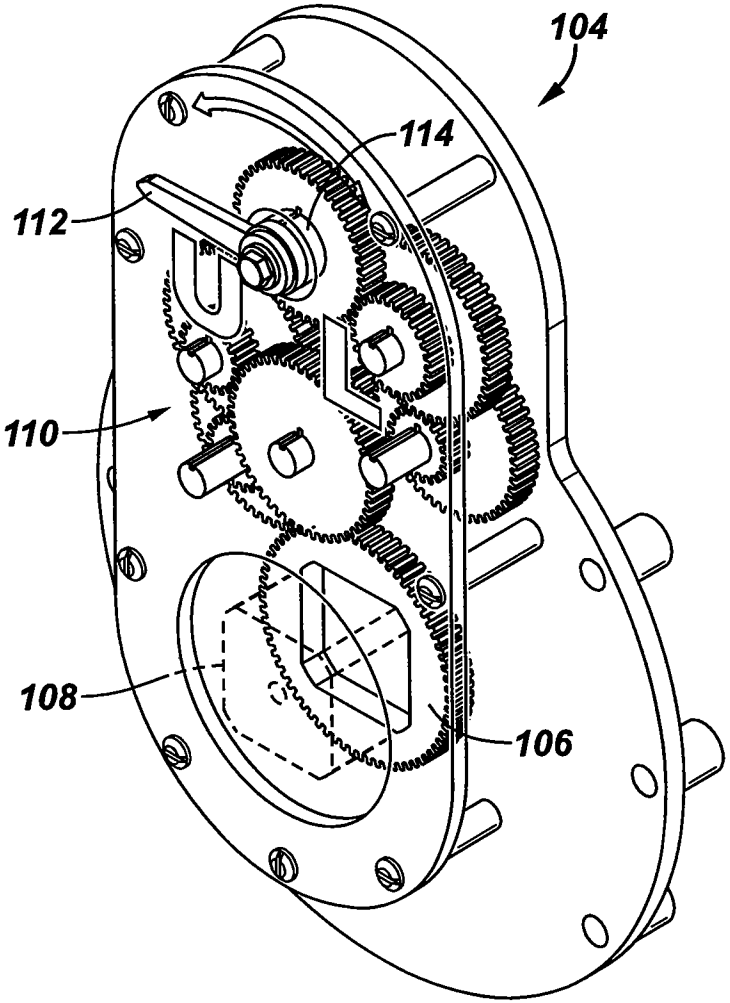
FIG. 4 is an illustrative, semi-transparent view of the gear assembly.

FIG. 3 is an illustrative status assembly 104 attached to a hydraulic motor 102 used to lock and unlock a ram of a ram-type BOP, such as shown in FIGS. 1 and 2. As further shown in FIG. 4, the gear assembly 104 includes a drive gear 106, a drive shaft 108, a series of gears 110, and an indicator 112, which in this embodiment is an indicator flag. The drive gear 106 receives a rotating element protruding from the hydraulic operator, also known as the motorshaft. In this embodiment, the rotating element is a rotating drive shaft 108 of the hydraulic motor 102. As the motor 102 operates, the drive shaft turns, turning the drive gear 106 with it. The drive gear bears on a reduction gear which, in sequence, then bears on a series of gears to convert twenty-four turns of the motor shaft into half a turn (180 degrees) of the final gear shaft 114 (the topmost gear in the figures) to which is also attached an indicator flag 112. In the example shown, when the flag is pointing horizontally to the left the lock is unlocked, when it is pointing horizontally to the right, it is fully locked, as shown in FIG. 5. It should be noted that any number of gears, including only one gear, may be used in the status assembly 104 even though the embodiment shown and described below includes multiple gears.

The "U" 115*a* represents the unlocked position and the "L" 115*b* represents the locked position of the gear assembly 104. The gear assembly offers precise representations of the lock status of the BOP. The indicator flag 112 position is directly related to the position of the locks on the BOP, and thus may indicate the position of the BOP ram and whether it is in the locked position. In other words, the indicator flag position is directly related to turns of the drive shaft 108 and drive gear 106. The unlock position 115*a* and the lock position 115*b* are shown on the front plate of the gear assembly 104. The indicator flag 112 moves in relation to the drive gear 106, drive shaft 108, and the final gear 114.

Figure 6:
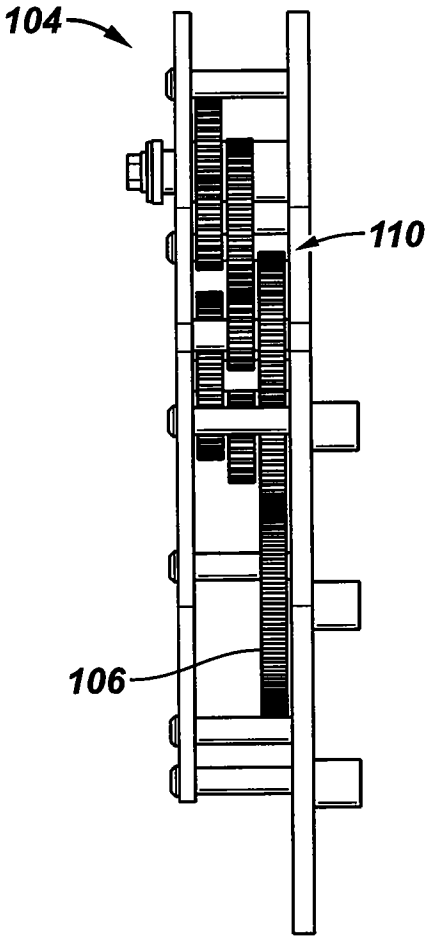
FIG. 6 is an illustrative side view of the gear assembly.

FIG. 6 illustrates a side view of the front plate with a series of gears 110 and the drive gear 106. The plates, gears, and shafts of the gear assembly 104 are made of a stainless steel suitable for deep subsea exposure, manufactured from 316 (standard) or from duplex stainless steels in order to withstand hostile subsea environments. Other subsea materials that can withstand such environments can also be used.

Figure 7:
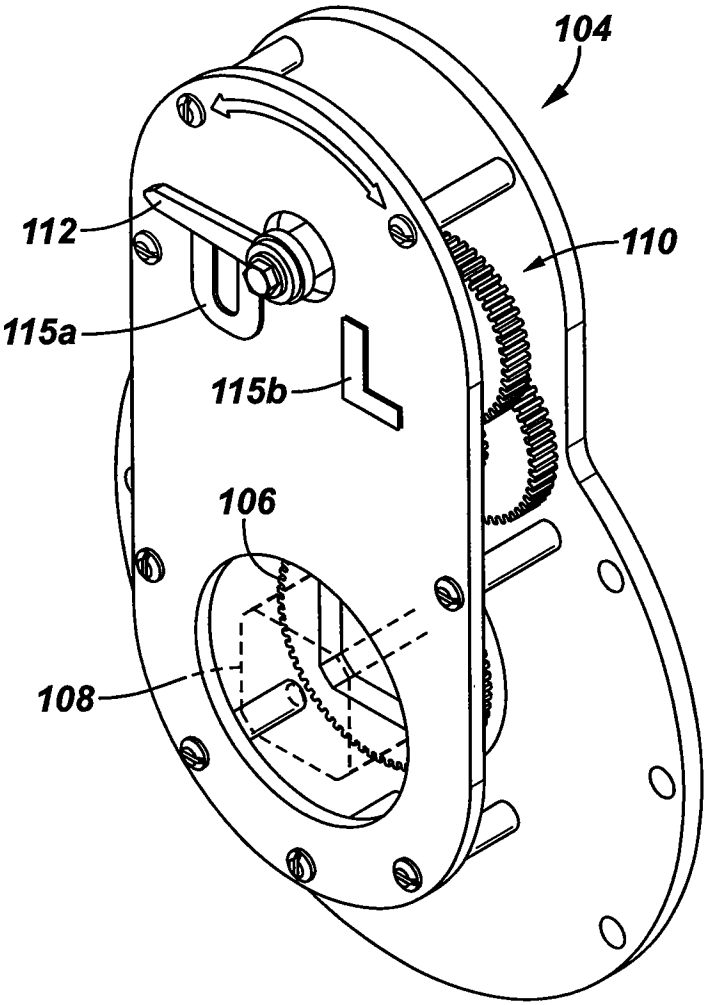
FIG. 7 is an illustrative isometric view of the gear assembly.

FIG. 7 shows an illustrative isometric view of the gear assembly 104 that includes the front plate, the series of gears 110, and the final gear 114.

Figure 8:
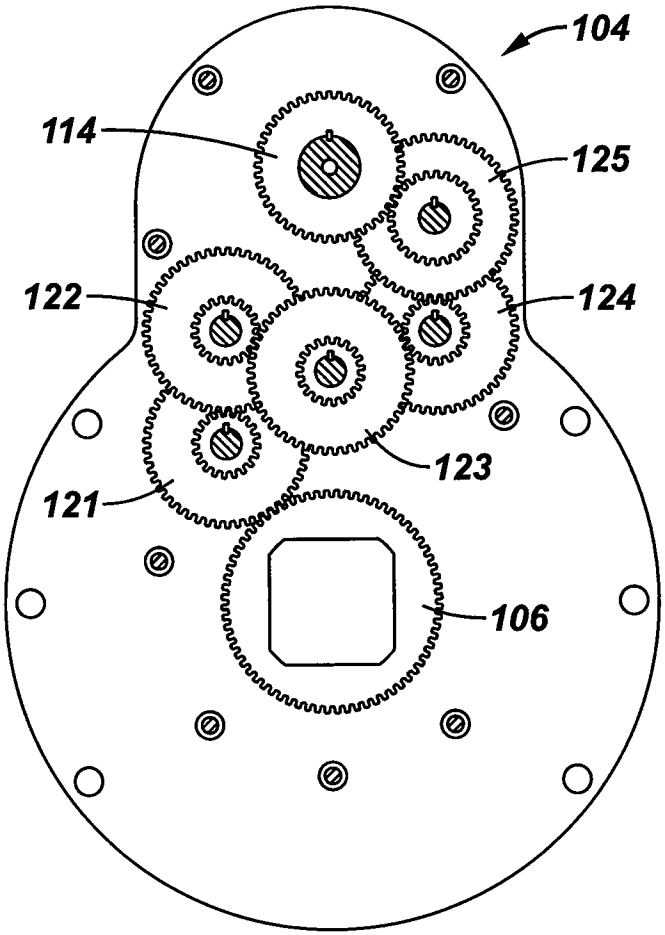
FIG. 8 is an illustrative front view of the gear assembly detailing the gear connections.

FIG. 8 shows an even closer view of the inner workings of the gear assembly 104. The drive gear 106 bears upon the first reduction gear 121. The first reduction gear 121, in turn, bears upon second reduction gear 122 that bears upon the third reduction gear 123. The third reduction gear 123 bears upon the fourth reduction gear 124 that bears upon the fifth reduction gear 125. The final gear 114 is controlled by the fifth reduction gear 125, and the position of the indicator flag 112 is controlled by the final gear 114.

Figure 9:
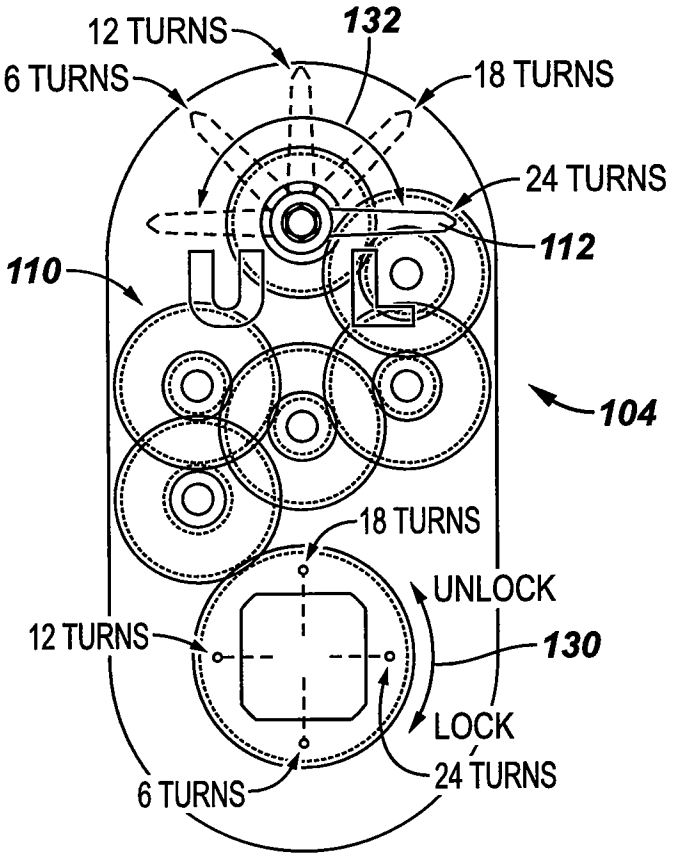
FIG. 9 is an illustrative front view of the gear assembly with gears and indicator flag motion.

FIG. 9 shows a detailed view of the number of turns of the protruding element 108 in relation to the position of the indicator flag 112 of this embodiment. One of the advantages of the present invention is the ability for an operator to visualize the position of the closure of the BOP within fractions of one inch. The embodiment shown in FIG. 9 is an illustration of the precision of the lock indicator. The indicator flag is designed to be visible to the pilot of an ROV sent to check the status of the BOP in terms of closure. The rotation 130 of the motor shaft turns 24 times between fully open and fully closed and vice versa, the gearing of the indicator unit is designed to effect the motion 132 of the indicator flag through one half turn (from either 9 o'clock to 3 o'clock in a clockwise direction when locking, or 3 o'clock to 9 o'clock in an anticlockwise direction when unlocking), as shown in FIG. 9. Due to backlash in the gear assembly and the fact that some ram arrangements will require slightly more travel and others slightly less, the indicator flag may travel slightly more or slightly less than 180 degrees between the fully open and fully closed conditions. This can be determined at the time the indicator is fitted to the BOP and suitable markings applied to the front plate of the gear assembly to indicate fully open and fully closed for that particular configuration.

One of the advantages of the unit is that if a BOP ram has not fully engaged, i.e. has not travelled the full length of its intended stroke when closing, then the lock motor will not be able to drive the locking mechanism to the full extent of its travel, which in turn means that the shaft rotation count will be short of the full number and the indicator flag will therefore point to a position that is short of the fully locked position. Such a visual indication of the failure or success of a BOP ram to fully engage is thought to be novel. The same holds true in reverse for determining whether the BOP ram has opened fully.

Other embodiments may include a sensor with an electronic output that measures the position of one the shafts of the gear assembly, such as the final gear and therefore the indicator flag, or the indicator itself. An electronic signal that is directly related to the position of the ram can be sent from the sensor to the system operator and incorporated into the main display for the BOP control system.

In one embodiment, a magnet is attached to the indicator flag 112 or the indicator flag 112 is a magnet itself. Magnetic sensors are spread across the arc of the indicator flag path. The sensors can be placed on either the front side or the back side of the front plate of the gear assembly 104 or both. In this embodiment, the sensors measure the position of the indicator flag and the status of the indicator flag is visually displayed graphically to a control operator based on the measurements from the sensors.

Figure 10:
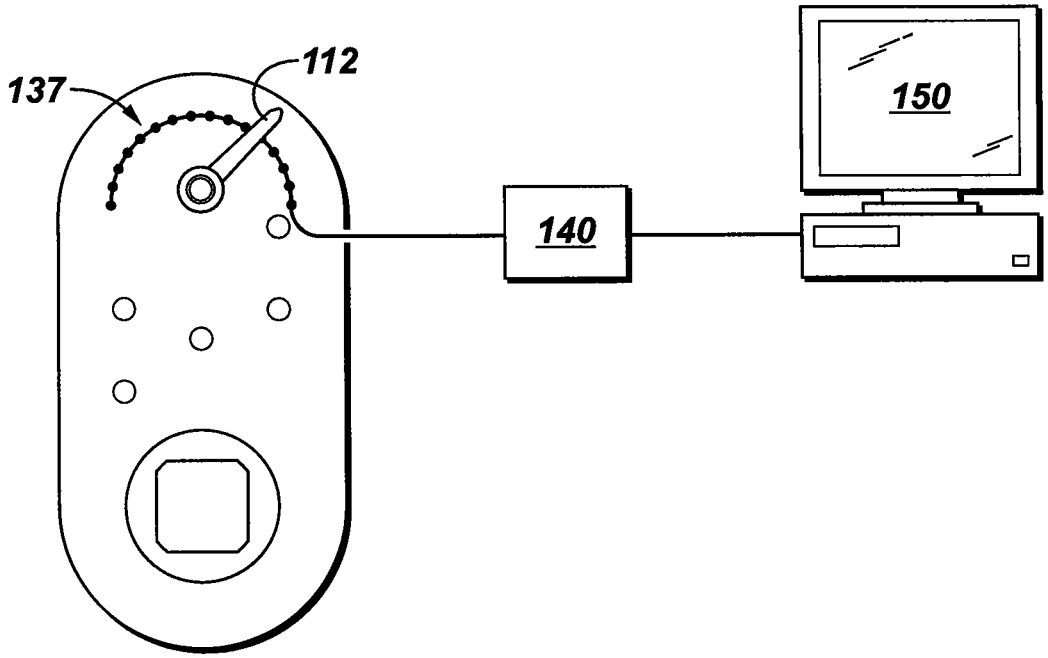
FIG. 10 is an illustrative sensor and control module.

FIG. 10 shows an embodiment of the status assembly including a sensor for measuring the rotation of the indicator 112. As shown, multiple sensors 137 are located along the path of the indicator 112. The preferred embodiment uses magnetic sensors 137 located along the travel path of the indicator 112 and a magnet attached to the indicator 112 to measure the position of the indicator 112. However, sensors can be of any type such as optical, electrical, etc. The sensors are in communication with a control module 140 and display output system 150.

The indicator 112 indicates the rotation position of the rotatable element and thus the BOP ram based on the output from the sensor can include a sensor 137 with an electronic output coupled to at least one of the series of gears, the drive gear, the drive shaft, the reduction gear, and the indicator 112. The sensor 137 sends a signal to a main control and information system 140 and indicates the exact location of the ram of the ram-type BOP. The electronic system takes the lock status indicator a step further by providing a means to check the lock status indicator without the launching of an ROV into the subsea environment. In addition, a graphical display is provided in real-time to a control operator regarding the exact location of the indicator flag of the presented lock status indicator, and thus the location of the BOP ram. This will give immediate secondary feedback to operators as to whether each ram has achieved its intended travel.

Some embodiments may also include a safety guard (not shown), which will enclose the gear assembly and prevent the introduction of fingers or other objects into the gear assembly.

Figure 11:
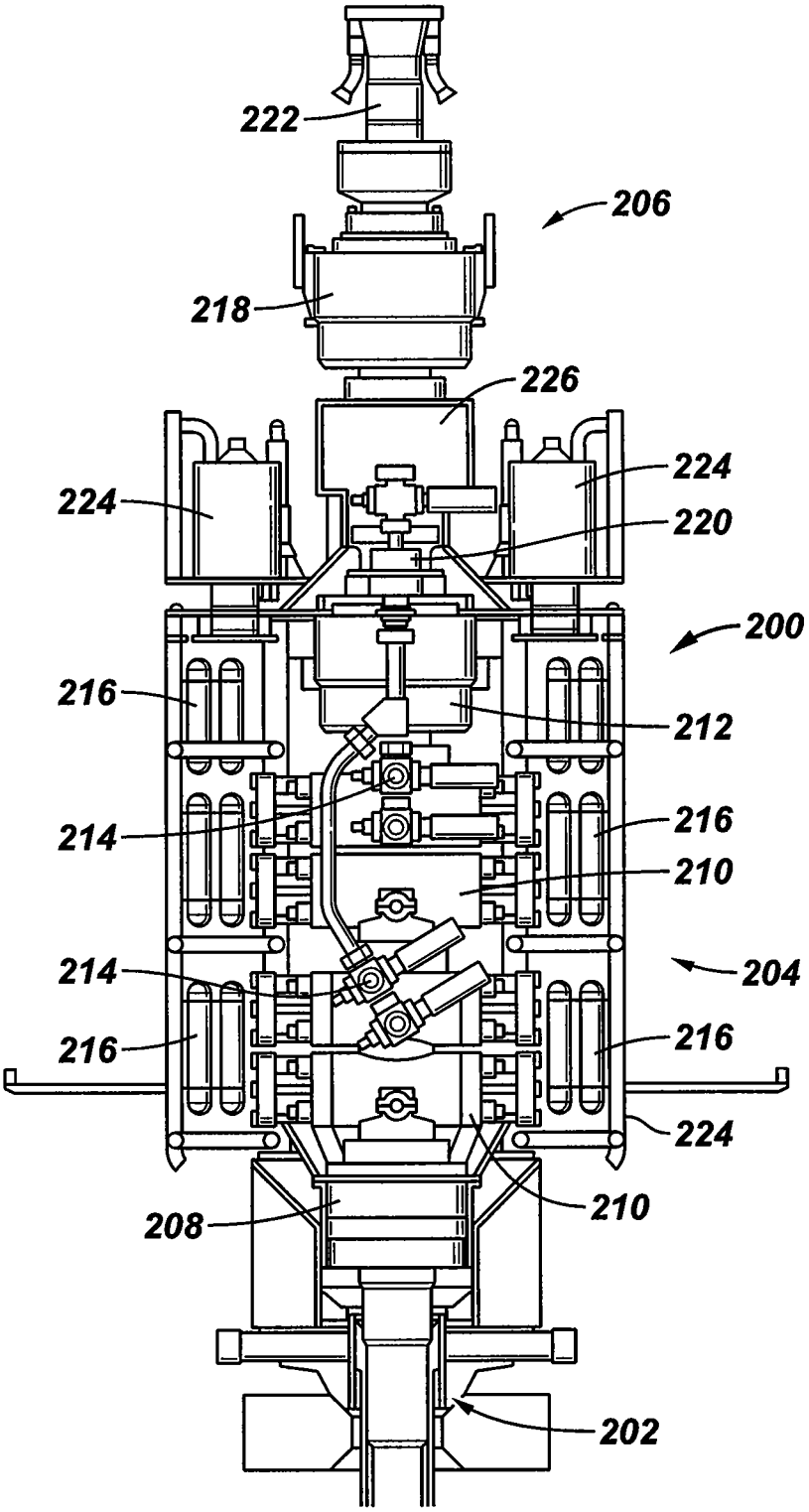
FIG. 11 is a blowout preventer stack assembly.

FIG. 11 shows another embodiment for an entire blowout preventer (BOP) stack 200 coupled to a wellhead 202. The BOP stack 200 comprises a lower stack assembly 204 and an upper stack assembly 206, or lower marine riser package (LMRP). The lower stack assembly 204 comprises a wellhead connector 208, ram BOPs 210, an annular BOP 212, choke and kill valves 214, and hydraulic accumulators 216. The LMRP 206 comprises an annular BOP 218, choke and kill connectors 220, a riser adapter/flex joint 222, control pods 224, and a collet connector 226. The collet connector 226 provides a releasable connection between the LMRP 206 and the lower stack assembly 204. The hydraulic accumulators 216 are mounted to a frame that surrounds the lower stack assembly 204. An entire BOP stack as described can include multiple status assemblies of the present invention to indicate the position of the BOP rams on multiple BOPs.

It should also be noted that the status assembly of the present invention can be retrofit to existing BOPs or any BOP with a protruding element. In addition, some embodiments of the present invention can include alarms to send out alerts when the ram of the ram-type BOP is in certain positions. Further, another advantage to having the protruding element accessible through the status assembly is to allow the operator of an ROV to cause the ROV to grab on to the protruding element and manually close or open the ram, if needed, without removing the status assembly.

Other embodiments can include alternative variations. These and other variations and modifications will become apparent to those skilled in the art once the above disclosure is fully appreciated. It is intended that the following claims be interpreted to embrace all such variations and modifications.

What is claimed is:

1. A status assembly for a blowout preventor (BOP) assembly that includes a rotatable element protruding from the BOP, the status assembly comprising:

a gear rotatable by the rotatable element; and an indicator that indicates the rotation position of the rotatable element, the indicator comprising:

a sensor for measuring the rotation of the gear and sending an output of the measurement; and an output that indicates the rotation position of the rotatable element based on the output from the sensor.

2. The assembly of claim 1, wherein the rotatable element is a rotating shaft of a motor of a locking mechanism for a ram of the BOP, the locking mechanism and ram being movable within the BOP, the assembly further comprising:

the gear comprising an opening for receiving the rotatable element;

the indicator indicating the position of the BOP ram; and wherein the angular position of the indicator is directly linked to the linear position of the ram.

3. The assembly of claim 2, wherein the BOP ram is movable in and out of a closed position and the indicator indicates the position of the ram.

4. The system of claim 2, wherein the rotatable element is capable of being manually rotated by an ROV.

5. The assembly of claim 1, further comprising:

more than one gear linked together for rotation; and the indicator being adjustable by a gear other than the gear for receiving the rotatable element.

6. The assembly of claim 5, wherein the gears comprise at least one reduction gear.

7. The assembly of claim 1, wherein the indicator is a visual indicator mechanically linked with the gear.

8. The assembly of claim 7, wherein the indicator is visible to a remotely operated vehicle pilot outside the assembly.

9. The assembly of claim 7, wherein the indicator is visible to any other device, including one mounted on the BOP assembly.

10. The assembly of claim 1, wherein the sensor is electronic and sends an electronic signal.

11. The assembly of claim 10, further comprising a main control and information system for receiving and retransmitting the electronic signal and graphically displaying the indicator.

12. A ram-type BOP system that comprises:

a first ram;

a second ram;

a first status assembly;

a second status assembly; and wherein both the first status assembly and the second status assembly each comprise:

a gear rotatable by a rotatable element; and an indicator that indicates the rotation position of the rotatable element, the indicator comprising:

a sensor for measuring the rotation of the gear and sending an output of the measurement; and a digital output that indicates the rotation position of the rotatable element based on the output from the sensor.

13. The system of claim 12 wherein the rotatable element is a rotating shaft of a motor of a locking mechanism for a ram of the BOP, the locking mechanism and ram being movable within the BOP, the first status indicator assembly and second status indicator assembly further comprising:

the gear comprising an opening for receiving the rotatable element;

the indicator indicating the position of the BOP ram; and wherein the angular position of the indicator is directly linked to the linear position of the ram.

14. The system of claim 13, wherein the BOP ram is movable in and out of a closed position and the indicator indicates the position of the ram.

15. The system of claim 13, wherein the rotatable element is capable of being manually rotated by an ROV.

16. The system of claim 13, wherein measurements can differ between the first ram and the second ram.

17. The system of claim 12, further comprising:

more than one gear linked together for rotation; and the indicator being adjustable by a gear other than the gear for receiving the rotatable element.

18. The system of claim 17, wherein the gears comprise at least one reduction gear.

19. The system of claim 12, wherein the indicator is a visual indicator mechanically linked with the gear.

20. The system of claim 19, wherein the indicator is visible to a remotely operated vehicle pilot outside the assembly.

21. The system of claim 19, wherein the indicator is visible to any other device, including one mounted nearby.

22. The system of claim 12, wherein the sensor is electronic and sends an electronic signal.

23. The system of claim 22, further comprising a main control and information system for receiving and retransmitting the electronic signal and graphically displaying the indicator.

* * * * *